United States Patent [19]

Murayama et al.

[11] Patent Number: 4,633,696

[45] Date of Patent: Jan. 6, 1987

[54] THREAD ROLLING METHOD

[75] Inventors: Kimimasa Murayama; Shoji Ikawa; Shinobu Kaneko, all of Aichi, Japan

[73] Assignee: Toyota Jidosha Kabushiki Kaisha, Toyota, Japan

[21] Appl. No.: 762,396

[22] Filed: Aug. 5, 1985

[30] Foreign Application Priority Data

Aug. 22, 1984 [JP] Japan ..... 59-174681

[51] Int. Cl.[4] ..... B21H 3/06

[52] U.S. Cl. ..... 72/88

[58] Field of Search ..... 72/88, 90, 104, 108, 72/71

[56] References Cited

U.S. PATENT DOCUMENTS

| | | | |
|---|---|---|---|
| 408,530 | 8/1889 | Rogers | 72/88 |
| 1,399,525 | 12/1921 | Schaad | 72/104 |
| 2,932,996 | 4/1960 | Yamamoto | 72/104 |
| 3,196,654 | 7/1965 | Gordon | 72/88 |
| 3,214,951 | 11/1965 | McCardell | 72/88 |
| 4,519,231 | 5/1985 | Roth | 72/88 |

*Primary Examiner*—Daniel C. Crane

*Attorney, Agent, or Firm*—Cushman, Darby & Cushman

[57] ABSTRACT

A forced rotational drive force is imparted to a workpiece in synchronism with the movement of a pair of thread rolling dies, the thread rolling dies having a lead angle selected to match the forced rolling diameter of the workpiece, for thereby forming screw threads on the workpiece. These thread rolling dies are moved toward each other to form screw threads on a workpiece. By adjusting the distance between the thread rolling dies to match the workpiece diameter before threading, there can be produced various screws having equal pitches and different nominal diameters.

4 Claims, 3 Drawing Figures

THREAD ROLLING METHOD

BACKGROUND OF THE INVENTION

1. Field of the Invention

The present invention relates to a method for forming external screw threads using flat dies, and more particularly to a thread rolling method for producing a variety of screw threads of different characteristics using one type of thread rolling die.

2. Description of the Prior Art

In forming screw threads using thread rolling flat dies, it has been customary to prepare flat dies designed to meet the characteristics of the screw threads to be produced. These characteristics include thread size, spacing, shape, dimensions and screw diameter. The flat dies are then attached to a pair of sliding mechanisms which move in synchronism with each other in a thread rolling machine. A workpiece is positioned supported by a centering mechanism between the sliding mechanisms. These sliding mechanisms (sliding means) are then moved in a thread rolling direction so as to be pressed against the workpiece so that threads are cut in the workpiece.

With the above conventional method, however, the flat dies must be replaced with other flat dies when it is desired to form screw threads of different characteristics. Production of various screw threads has therefore required that thread rolling dies be replaced many times during the process. This has led to drawbacks in that the rate of production cannot be increased, and the cost of manufacturing screws is raised.

SUMMARY OF THE INVENTION

In response to this problem, it is an object of the present invention to provide a method capable of forming various screw threads of equal pitches, but of a different nominal diameter of workpiece on a single type of thread rolling die.

According to the present invention, a forced rotational drive force is imparted to a workpiece in synchronism with the movement of a pair of thread rolling dies, and the thread rolling dies are moved relative to each other. These thread rolling dies have a lead angle which is selected to match the forced rolling diameter of the workpiece, thereby forming screw threads on the workpiece.

With this method, the workpiece is forcibly rotated during the thread rolling process irrespective of the diameter thereof before threading. As a result, the thread rolling dies slip with respect to the workpiece so as to enable the workpiece to approach a lead angle matching the characteristics of a desired product, so that a screw of normal shape will finally be produced. For producing two screws having equal pitch but different diameters, only the distance between the thread rolling dies need to be varied. Therefore, various screw threads of equal pitches and differing nominal diameters can be produced by one type of thread rolling die. The number of thread rolling dies to be kept for ready use and the number of steps for replacing the thread rolling dies can accordingly be reduced, with the consequences that the rate of production of screws will be increased and the cost of manufacture of screws will be lowered.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
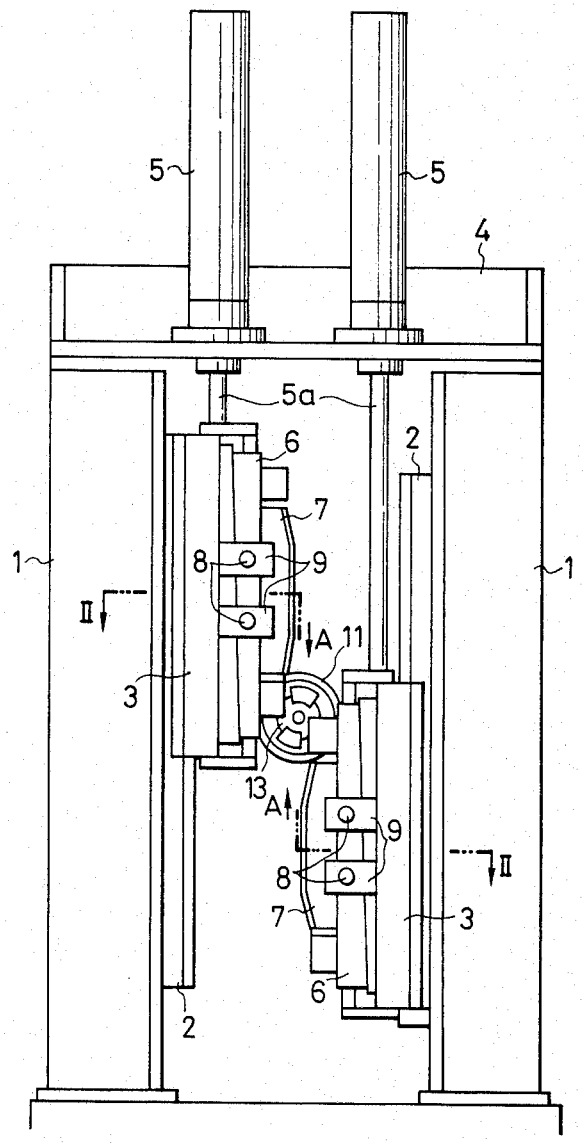
FIG. 1 is a front elevational view of a thread rolling apparatus according to the present invention.
Figure 2:
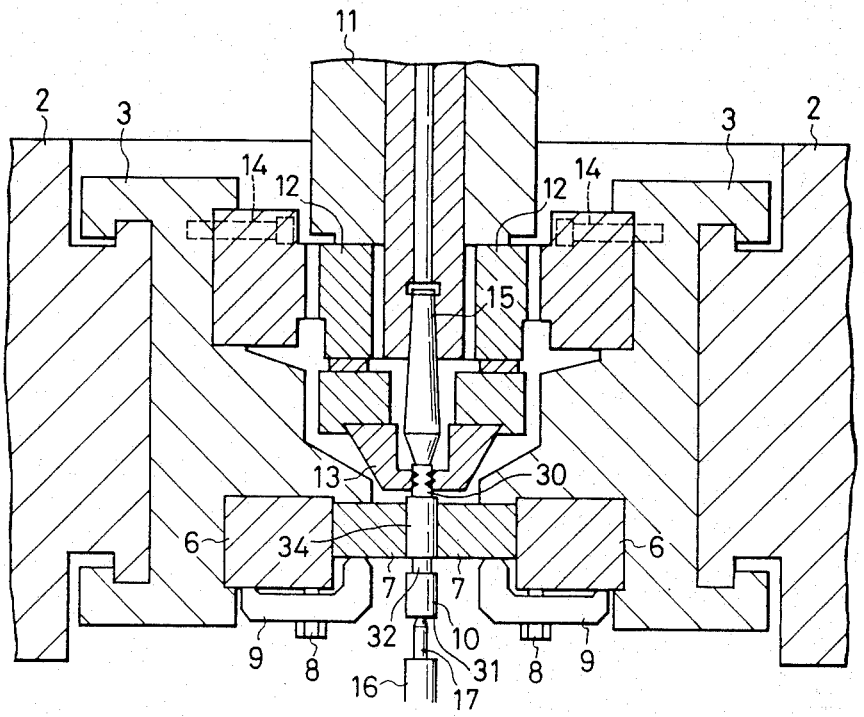
FIG. 2 is a cross-sectional view taken along line II—II of FIG. 1.

As shown in FIGS. 1 and 2, a thread rolling apparatus according to the present invention includes a pair of laterally spaced columns 1 to which a pair of vertical guide members 2 are fixed, respectively, on and along the inner side surfaces of the columns 1. A sliding mechanism 3 is movably mounted so that it can travel in a vertical direction along each of the vertical guide members 2. The sliding mechanisms 3 are connected to the output shafts 5*a* of a pair of actuators 5. These actuators 5 are fixedly mounted on a mount base 4, which is joined transversely to the upper ends of the columns 1. Thus, the sliding mechanisms 3 can move upwardly and downwardly along the vertical guide members 2 under control of the actuators 5.

A thread rolling die 7 is attached by a wedge means 6 to each sliding mechanism 3. Specifically, clamp means 9 are attached by bolts 8 to sliding mechanism 3. By threading bolts 8 through wedge means 6 and into sliding mechanism 3, wedge means 6 and thread rolling dies 7 are securely anchored between sliding mechanisms 3 and clamp means 9. The distance between thread rolling dies 7 can thus be varied by appropriately selecting the position of wedge means 6 with respect to sliding mechanisms 3, so that thread rolling dies 7 can form screw threads of varying characteristics, as described herein.

Referring to FIG. 2, main shaft 11 is positioned in between columns 1, and extends in a direction normal to the plane joining thread rolling dies 7. Main shaft 11 serves as a support means for a workpiece 10 as described herein. A synchronous pinion 12 is rotatably mounted on the distal end of the main shaft 11. Secured to the synchronous pinion 12 is a chucking mechanism 13 which grips the chucked portion 30 of workpiece 10. Synchronous racks 14 for meshing with the synchronous pinion 12 are attached to sliding mechanisms 3 thus forming a rack and pinion drive train. When sliding mechanisms 3 are moved upwardly and downwardly in a tangential direction to the workpiece, by actuators 5, the drive force imparted to sliding mechanisms 3 is transmitted through synchronous racks 14 and synchronous pinion 12 as a rotational drive force to chucking mechanism 13. Chucking mechanism 13, which holds chucked portion 30 of workpiece 10, is thus forcibly rotated, thus effectively rotating workpiece 10.

The apparatus also includes a tail stock 16 butted against head 31 of workpiece 10 with its center portion 17. Above the portion of workpiece 10 against which center portion 17 contacts is a narrow portion 32 of workpiece 10. Superjacent to narrow portion 32 is portion to be processed 34. The distal end of workpiece 10 (chucked portion 30) is held by chucking means 13. Centering means 15 is rotatably disposed in main shaft 11, and a tail stock 16 which is movable toward and away from the main shaft 11 in coaxially confronting relation thereto. Centering means 15 and tail stock 16 also jointly serves as a support means for positioning the workpiece 10 in a desired position.

Figure 3:
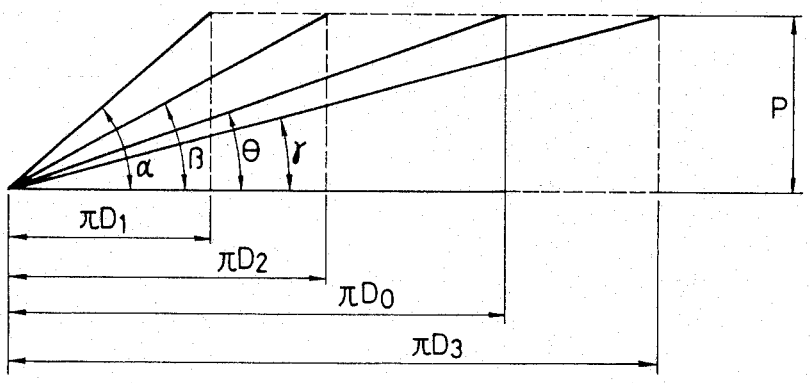
FIG. 3 is a diagram explaining a process for setting the lead angle of the thread rolling dies.

The thread rolling dies 7 in accordance with the present invention are adapted to have their lead angles set to match differing forced rolling diameters of workpiece 10 (thereby matching differing screw diameters). As an example, referring to FIG. 3, different screw diameters before threading are denoted as $D_1$, $D_2$, and $D_3$, with a constant screw pitch P. The screws $D_1$, $D_2$ and $D_3$ have lead angles, $\alpha$, $\beta$, and $\psi$ respectively. It is assumed that the chucked portion of the workpiece 10 has an outside diameter of $D_0$. Thus, the screw pitch P is selected with respect to the rolling diameter of $D_0$, with $\theta$ being the angle of inclination according to the relation:

$$\theta = \tan^{-1}\left(\frac{P}{\pi D_0}\right)$$

The thread rolling dies 7 are all initially set to this lead angle of $\theta$ irrespective of the screw diameters (dimensions) before threading.

When screw threads are to be formed, the wedge means 6 are appropriately selected to be in a position for bringing the distance between thread rolling dies 7 into matching relation to the screw characteristics. Then, chucked portion 30 of workpiece 10 is clamped between the centering means 15 and tail stock 16 and is held by the chucking mechanism 13. The thread rolling dies 7 are initially spaced apart in a thread rolling direction as shown in FIG. 1. When actuators 5 are engaged, sliding means 3 and hence thread rolling dies 7 are moved in the directions of the arrows A (in FIG. 1) and thus form screw threads on the workpiece 10.

As sliding mechanisms 3 are advanced (moved in direction A), the drive force imparted thereto is transmitted through synchronous racks 14 and synchronous pinion 12 as a rotational drive force to the chucking mechanism 13. Thus, workpiece 10 is forcibly rotated. Therefore, different diameter workpieces are rotated at the same angular velocity, with the result that the peripheral speed of the different diameter workpieces 10 vary with respect to thread rolling dies 7.

During such an operation, the thread rolling dies 7 are caused to slip with respect to the workpiece 10 so as to enable the screw being forced to approach a lead angle ($\alpha$ for example) matching the characteristics of the product, so that a screw of normal shape will finally be produced. That is, as the forming threads of the present invention is a kind of cold forming, if the peripheral speed of the portion to be processed of the workpiece is smaller or larger than the moving speed of the dies, there occurs a mutual slip between them resulting in various lead angles which are predetermined by the diameter of the portion to be processed.

In other words, the r.p.m. of the workpiece is determined automatically by the r.p.m. of the chuck, therefore the lead angle is changed owing to the diameter of the portion of being processed, i.e. the peripheral speed.

Since the workpiece 10 is forcibly rotated at its chucked diameter and the lead angle is determined without regard to the diameter before threading, various screws having equal pitches and different nominal diameters, i.e., different diameters before threading ($D_2$, $D_3$ for example) can be formed simply by changing the position of wedge means 6 with respect to sliding means 3, thereby varying the distance between thread rolling dies 7. Therefore, a wide variety of screws can be produced by the same thread rolling dies.

For example, the thread rolling apparatus can produce screws such as ¼-20, 5/16-20 and ⅜-20 from a single die.

While the wedge means (depicted as wedges) have been employed to vary the distance between the thread rolling dies 7, shims of simple shape may instead be disposed on the back surfaces of thread rolling dies 7 for varying the distance therebetween. The clamp means 9 may be replaced with another means for clamping the wedge 6 and the companion thread rolling die 7.

Although a certain preferred embodiment has been shown and described, it should be understood that many changes and modifications may be made therein without departing from the scope of the appended claims.

What we claim is:

1. A method of producing threads on a plurality of different workpieces of different diameters, comprising the steps of:

providing a plurality of workpieces having different diameters;

adjusting the distance between at least two dies to match the diameter of a desired workpiece;

moving said dies for each selected workpiece in a direction tangential to said selected workpiece;

rotating each of the plurality of workpieces in synchronism with said moving of said dies, peripheral speeds of said workpieces are different from said die moving speed causing slip between said dies and said workpieces, and thereby cutting threads on said workpieces at a constant pitch for all workpiece diameters, lead angles of the threads depending on rolling diameters of said workpieces to maintain pitch constant independent of workpiece diameter.

2. A method of manufacturing workpieces having threads of different lead angles with an identical pitch thereon comprising the steps of:

(a) providing a plurality of workpieces having different diameters;

(b) setting the space between two thread rolling dies which have a predetermined lead angle and arranging a workpiece holding chuck adjacent the two thread rolling dies so that a workpiece can be held by the chuck and situated between the dies;

(c) mounting one of said workpieces within said chuck;

(d) moving said two thread rolling dies relative to each other at a die moving speed to produce threads on said workpiece;

(e) again performing steps (c) and (d) on each of the remaining workpieces; and rotating each workpiece in synchronism with said moving of said thread rolling dies by driving said chuck, each said workpiece rotating speed being selected so that said peripheral speed of the workpieces are different from said die moving speed to cause slippage between the dies and the workpieces to thereby form screw threads on the workpieces having a pitch which is constant for workpieces of all diameters, variations between diameters of workpieces producing variations in slippage, causing necessary variations in lead angle to maintain pitch constant independent of workpiece diameter.

3. A method as in claim 2 comprising the further steps of:

setting a different space between the two thread rolling dies for a different diameter of workpiece to be thread rolled; and rolling threads on the different diameter workpiece.

4. A thread rolling method according to claim 2, wherein the distance between said thread rolling dies is variable for producing screw threads on varying diameter workpieces.

* * * * *